US006019651A

United States Patent [19]

Driscoll et al.

[11] Patent Number: 6,019,651

[45] Date of Patent: Feb. 1, 2000

[54] FLOTATION DEVICE AND METHOD OF USING SAME

[75] Inventors: Paul K. Driscoll; Michael H. Wahl, both of San Diego, Calif.

[73] Assignee: Life Safer, Inc., San Diego, Calif.

[21] Appl. No.: 09/092,276

[22] Filed: Jun. 6, 1998

[51] Int. Cl.[7] ..... B63C 9/26

[52] U.S. Cl. ..... 441/84; 441/81

[58] Field of Search ..... 441/80, 81, 83, 441/84

[56] References Cited

U.S. PATENT DOCUMENTS

| | | | |
|---|---|---|---|
| 1,140,358 | 5/1915 | Cleave | 441/81 |
| 2,342,868 | 2/1944 | King . | |
| 3,099,845 | 8/1963 | Chamberlain | 441/81 |
| 3,378,865 | 4/1968 | Pigg . | |
| 3,710,505 | 1/1973 | Linenfelser . | |
| 3,974,536 | 8/1976 | Franklin . | |
| 4,059,859 | 11/1977 | Hull . | |
| 4,204,357 | 5/1980 | Harrington . | |
| 4,416,640 | 11/1983 | Eickenhorst . | |
| 4,449,947 | 5/1984 | Brault . | |
| 4,498,880 | 2/1985 | Curley . | |
| 4,523,913 | 6/1985 | Kaino . | |
| 4,540,372 | 9/1985 | Mauck . | |
| 4,701,145 | 10/1987 | Foresman . | |
| 4,713,033 | 12/1987 | Cameron . | |
| 4,976,642 | 12/1990 | Wilkie . | |
| 5,433,637 | 7/1995 | Graves . | |
| 5,458,515 | 10/1995 | Busetti . | |
| 5,562,512 | 10/1996 | Samelian . | |
| 5,895,299 | 4/1999 | Hyde | 441/84 |

FOREIGN PATENT DOCUMENTS

| | | | |
|---|---|---|---|
| 1225545 | 8/1987 | Canada | 114/60.3 |

*Primary Examiner*—Sherman Basinger
*Attorney, Agent, or Firm*—William Patrick Waters

[57] ABSTRACT

A flotation device for rescue of individuals in distress in static or swift water or under icy conditions. A preferred embodiment includes a throwable disk having an annular groove wherein the disk is divisible into a pair of separate, positively buoyant subassemblies. A web-like harness is stowed in a recess within each subassembly and a line is fixed at one end to the harness. In the nondeployed condition, the line is wrapped, spool-like, about an annular groove in the disk, thereby holding the subassemblies together. In use, a rescuer holds the free end of the line in one hand and, with the other, throws the disk in the direction of the person to be rescued. During flight, the line unwinds from the disk. Desirably, the disk is thrown beyond the person in distress to be subsequently drawn by the rescuer toward that person. When the line has been unwound from the disk, the subassemblies separate and the harness is pulled out of the storage recesses in the subassemblies. At this point, the separated subassemblies float on the water surface, with the harness deployed between them.

25 Claims, 3 Drawing Sheets

FLOTATION DEVICE AND METHOD OF USING SAME

BACKGROUND OF THE INVENTION

The present invention relates generally to rescue devices and, more particularly, to flotation devices for use in rescue of persons in danger of drowning in static or swift water.

A person in danger of drowning in static or swift water, or where ice is present, has an urgent need for immediate and effective assistance if drowning is to be prevented. In general, effective life saving techniques involve stabilizing the person in the water and then, in a controlled manner, moving the stabilized person to a safe location, away from the life threatening condition.

In this regard, conventional devices such as life rings are well known. In some cases the life ring is in the form of a spool having a line wrapped around it and, in use, a rescuer holds a free end of the line and throws the flotation device in the direction of the drowning person.

Often, the conventional flotation device is composed of a dense foam material or it is hollow. In either case, the device tends to be heavy and in use, a potential for injury to the eye or neck of the victim is a concern. Further, some conventional devices are difficult to grasp because of slippery surfaces or their usage may not be readily apparent to the person in distress.

In addition, since the device frequently must be thrown over a distance, it may have an aerodynamic configuration to aid it in flight. Such a design, however, can present limitations when the device enters the swiftly flowing water since the aerodynamic design can cause the device to submarine and become invisible to the person in distress.

In view of the foregoing, there is a need for a flotation device that will provide positive buoyancy to a person in distress while minimizing the likelihood of injury to the person. Desirably, such a device would provide a capability of stabilizing the person in distress and also have a capability for moving the person to a safe location. Additionally, the device would provide positive buoyancy to the person in static and swift water conditions and during ice rescues.

DISCLOSURE OF THE INVENTION

The object of the present invention is to provide a flotation device for use in rescue of persons in danger of drowning wherein the device is capable of being thrown accurately over a substantial distance.

It is another object of the present invention to provide a flotation device that is capable of providing sufficient buoyancy to meet Class IV (16.5 lbs.) or Class V (15 lbs.) as set forth in the U.S. Coast Guard Manual.

It is a further object of the present invention to provide a flotation device that reduces the risk of injury to the person in distress.

It is a still further object of the present invention to provide a flotation device that is convenient to use and compact enough to be readily portable.

It is an even still further object of the present invention to provide a flotation device that is constructed of readily available materials and is relatively low in cost.

The above and further objects of the present invention are realized by providing a flotation device for rescue of individuals in distress in static or swift water or under icy conditions. A preferred embodiment includes a throwable disk having an annular groove wherein the disk is divisible into a pair of separate, positively buoyant subassemblies. A web-like harness is stowed in a recess within each subassembly and a line is fixed at one end to the harness. In the nondeployed condition, the line is wrapped, spool-like, about an annular groove in the disk, thereby holding the subassemblies together. In use, a rescuer holds the free end of the line in one hand and, with the other, throws the disk in the direction of the person to be rescued. During flight, the line unwinds from the disk. Desirably, the disk is thrown beyond the person in distress to be subsequently drawn by the rescuer toward that person. When the line has been unwound from the disk, the subassemblies separate and the harness is pulled out of the storage recesses in the subassemblies. At this point, the separated subassemblies float on the water surface, with the harness deployed between them.

The present invention affords several advantages. In this regard, the disk combines effective positive characteristics with an aerodynamic configuration for facilitating a throw over a distance. In addition, the embodiment of the present invention is light in weight, composed of readily available materials and aerodynamically shaped for accurate throwing. In addition, the feature of separable, positively buoyant, subassemblies provides a means for the person in distress to have several places of purchase including each of the subassemblies and the harness deployed between them. Further, because of its configuration, and because of the presence of the separable subassemblies, the throwable disk of the present invention does not sink beneath the surface of the water after it lands, even in swift water conditions.

In addition, the present invention can be used without significant risk of injury to the person in distress and because it exposes only soft material on the outer surfaces.

The line utilized with the throwable disk of the present invention can be of varying lengths according to need. For example, for rescues at sea where a substantial distance might separate the person in distress from the rescuer, the line can be as long as about 100 feet. In other cases, for lakes or rivers for example, a shorter length of between about 50 feet to about 100 feet, or between about 5 feet and 50 feet, may be suitable.

Other aspects and advantages of the present invention will become apparent from the following detailed description, taken in conjunction with the accompanying drawings, illustrating by way of example the principles of the invention.

BEST MODE FOR CARRYING OUT THE INVENTION

Figure 1:
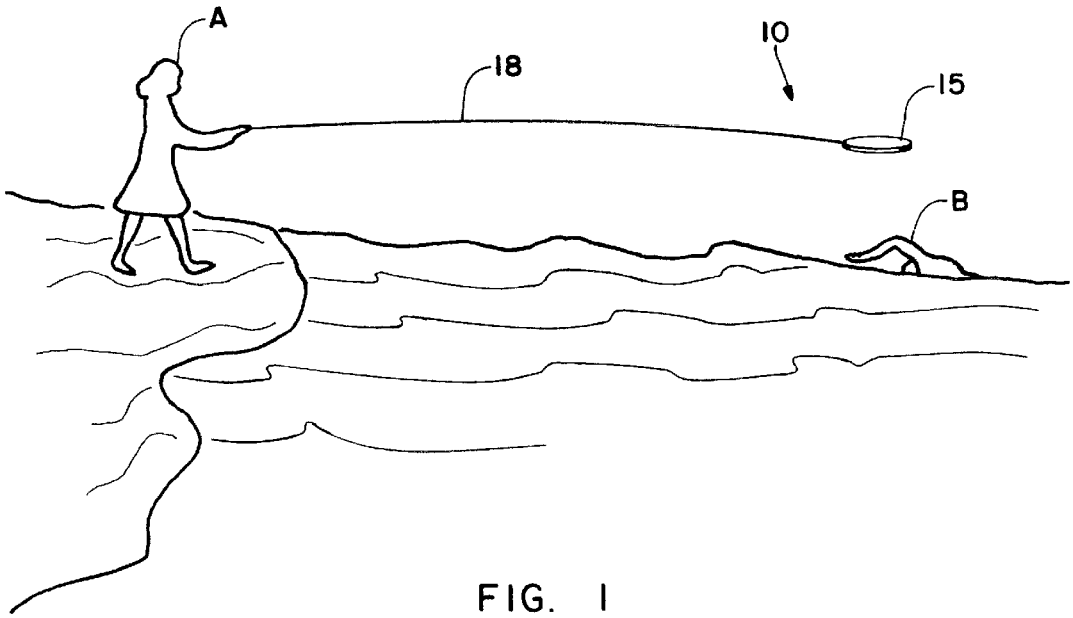
FIG. 1 is a pictorial view of showing the present invention in use for rescuing a person in danger of drowning.

Referring now to the drawings in detail wherein like numerals refer to like elements throughout the several views, there is shown a preferred embodiment of the invention. In FIG. 1, there is shown a flotation device 10 which is constructed according to the present invention. The flotation device 10 includes a pair of releasably joined, positively buoyant subassemblies 12 and 14 which, when joined, comprise a disk 15. The disk 15 has formed therein an annular groove 16 in which a polyethylene or polyester line 18 is wound in a spool-like manner.

A rescuer generally depicted as A, while holding a free end of the line 18, has thrown the disk 10 in the direction of a person in distress, generally depicted as B. Preferably, the aerodynamically shaped disk 15 enables the rescuer A to the throw the disk beyond the person B. The disk 15 spins around an axis of symmetry S, in a direction indicated by the arrow M (FIG. 2), as it flies through the air and the line 18 unwinds from the annular groove 16. When the disk 15 has landed in the water and the line 18 is fully deployed, the rescuer A can draw the line 18, to move the disk 15 toward the person B.

After the person in distress B has grasped a portion of the flotation device 10, the rescuer A utilizes the line 18 to draw the person B to a safe location. The light weight and the aerodynamic configuration of the disk 15 enable even young people or people with limited strength to throw the disk a considerable distance. In the embodiment herein disclosed, for example, a line 18 having a length of about 100 feet, is suitable.

Considering now the flotation device 10 with respect to FIGS. 1–6, the device includes a pair of identical separable subassemblies 12 and 14 which are constructed of high tensile strength closed foam cell material, and, in the preferred embodiment, the subassemblies are identical. This factor, of course, is advantageous in the manufacturing process since the subassemblies are interchangeable. However, it is not intended to limit the scope of the present invention to identical subassemblies. Variations in size and other subassembly characteristics can occur while the floatation device 10 still falls within the scope of the present invention.

Figure 2:
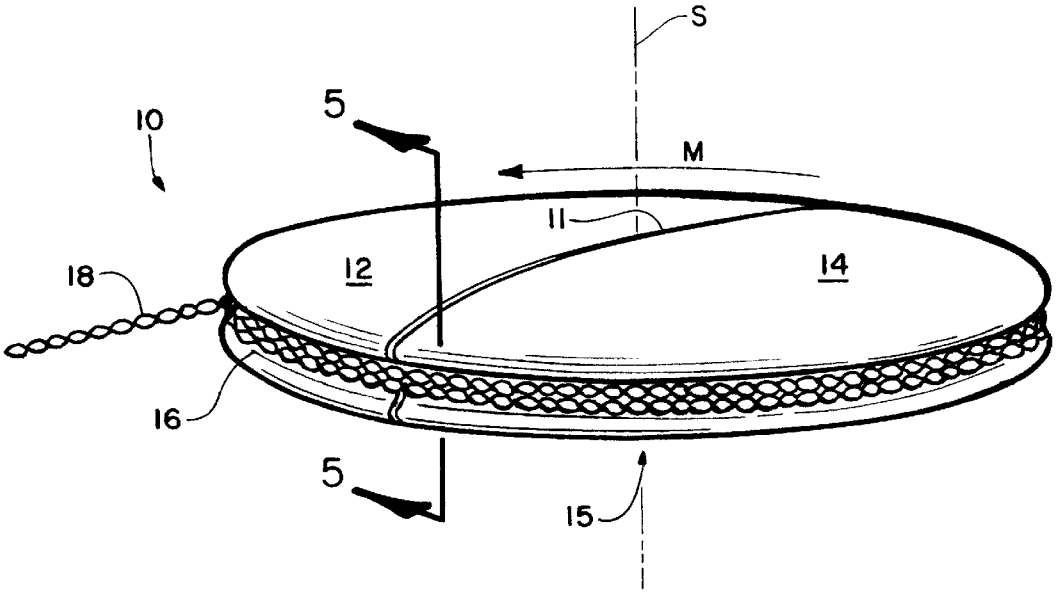
FIG. 2 is a perspective view of a preferred embodiment of the present invention.

As seen in FIG. 2, as the thrown flotation device 10 flies through the air and the line 18 unwinds from the annular groove 16, the subassemblies 12 and 14 separate along a line of separation 11 in a manner more fully described with reference to FIG. 4.

Figure 3:
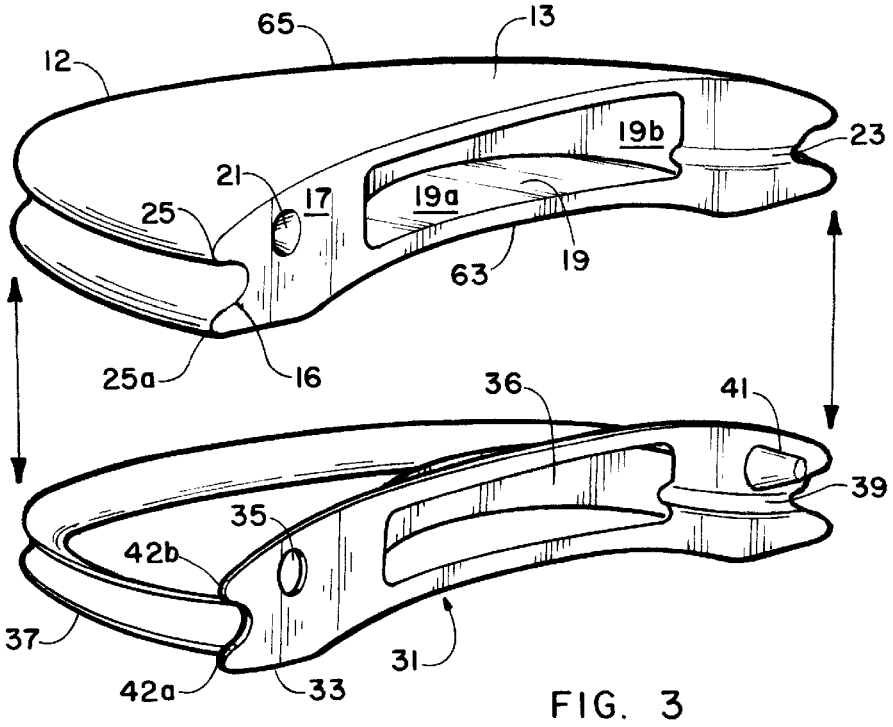
FIG. 3 is a perspective view of one of the subassemblies, and a strengthening member, of the preferred embodiment.

Referring now to FIG. 3, there is shown the subassembly 12 in separated relationship with a strengthening member 31.

The subassembly 12 has a generally convex top surface 65 and generally concave bottom surface 63 and, in top plan view it is semicircular in shape. An upper lip 25 and a lower lip 25*a* extend radially to help form the annular groove 16. A generally flat medial wall 17 is formed in the subassembly 12. Located at about the center of the wall 17, there is formed a radially disposed recess 19 having a bottom wall 19*a*, a top wall (not shown), and a curved side wall 19*b* which is connected to both the bottom wall 19*a* and the top wall.

A radial groove 23 is formed in the wall 17 for receiving the line 18. A recess 21, having a generally conical shape, is formed in the wall 17 at a location generally opposite that of the radial groove 23.

Considering now the strengthening member 31, the member is constructed of light weight hard plastic material. It is intimately attached to the subassembly 12 to lend strength and integrity to the flotation device 10 without appreciably increasing the weight or complexity thereof.

The strengthening member 31 includes a plate 33 which corresponds substantially to the wall 17 of the subassembly 12. An arcuate groove support 37 is fixed to the plate 33 being attached thereto at opposite sides of the plate. In use, the arcuate groove support 37 fits within the groove 16 of the subassembly 12 to contribute to the structural strength and stability of the flotation device 10. A pair of lips 42*a* and 42*b* extend laterally on either side of the plate 33 and, while these lips conform generally in shape to that of the lips 25*a* and 25, respectively, their lateral extension is less than that for the lips 25 and 25*a*.

The plate 33 includes an aperture 35 which corresponds to the opening 21 in the subassembly 12. In addition, an arcuate sidewall support 36 extends radially from the face 33 to provide structural support for the side wall 19*b*. A radially disposed groove 39, formed in the plate 33, extends across the outside portion of the plate 33 in a location corresponding to the groove 23 of the subassembly 12. A truncated cone 41 extends from the plate 33 near the edge thereof. In assembly of the disk 15, the conical projection 41 of one subassembly extends through the aperture 35 to fit into the recess 21 of the corresponding subassembly, thereby providing ease of registration and alignment of the two subassemblies.

Figure 4:
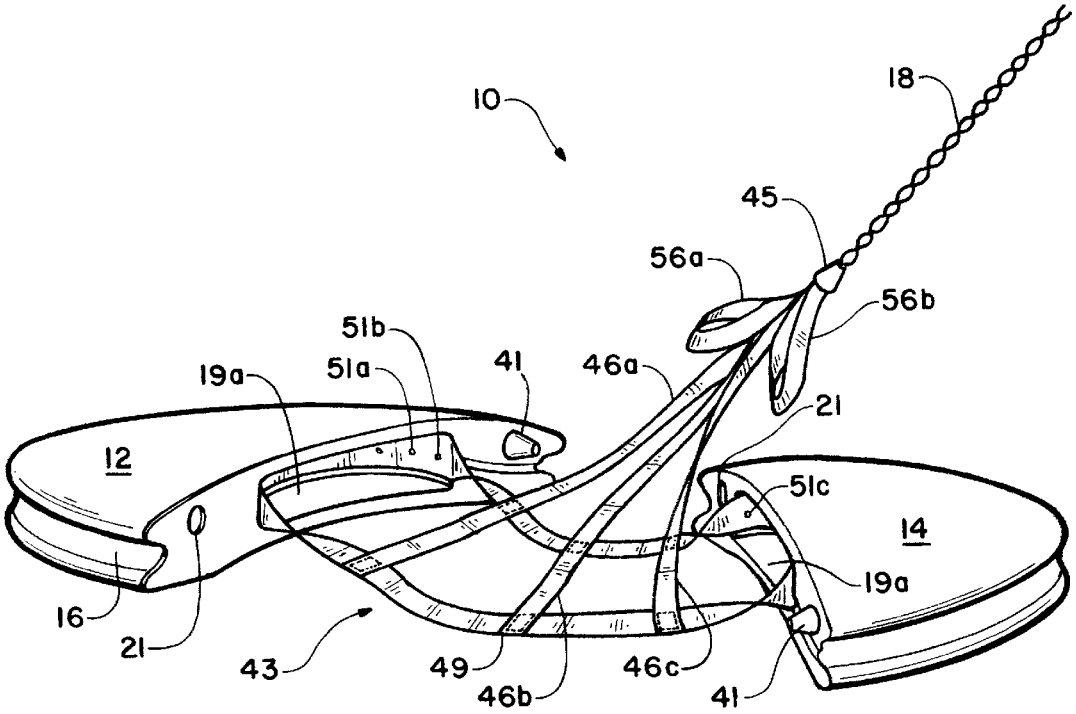
FIG. 4 is a perspective view showing the embodiment of FIG. 2 in a deployed condition.

Referring now to FIG. 4, there is shown the flotation device 10 in a deployed condition. Here, the line 18 has been completely unwound and has separated from the subassemblies 12 and 14. A harness assembly 43 which had been stowed in the recess 19 of the subassemblies 12 and 14 has been drawn therefrom into the deployed condition. The harness assembly 43 is attached to the line 18 by a conically shaped ring 45.

The harness assembly 43 includes a plurality of straps, such as the straps 46*a*, 46*b* and 46*c*, each of which is attached to a looped strap 48 in a conventional manner, such as by the stitching 49. The looped strap 48 is conventionally fixed to the sidewall support 36 by bonding or by other attachment means such as the rivets 51*a*, 51*b* and 51*c*. The looped strap 48 and the straps 46*a*, 46*b* and 46*c* are conventional nylon straps having a width of about ½ inch to about ¾ inch. They are gathered in a conventional manner at the cone shaped ring 45 where two loops of strap material 56*a* and 56*b* are formed.

In operation of the flotation device 10, as the thrown disk 15 rotates and the line 18 is extracted along the groove 39, the cone shaped ring 45 helps to separate the disk along a line of separation 11 so that the assemblies 12 and 14 are deployed in the water with the harness 43 deployed between them. It will be apparent that the separated subassemblies 12 and 14 offer positive buoyancy to the person in distress B In addition, the straps of the harness assembly 43 and the loops 56*a* and 56*b* afford several places which the person in distress can grasp in order to stay afloat.

Figure 5:
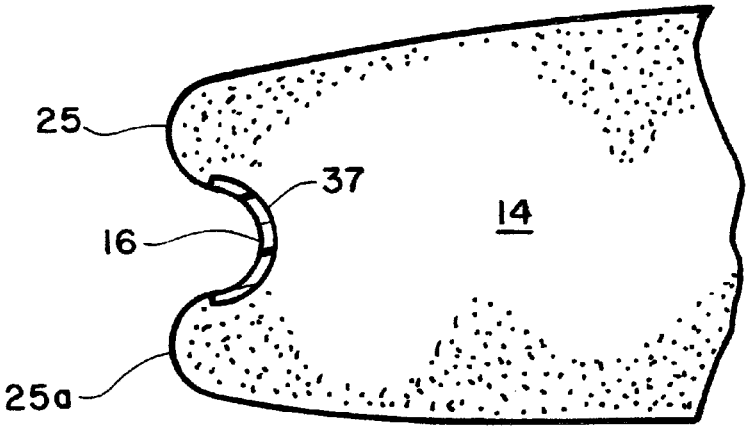
FIG. 5 is a view taken along the line 5—5 of FIG. 2.

Referring now to FIG. 5, there is shown a portion of the subassembly 14 and the radially disposed lips 25 and 25*a* which form the annular groove 16. One of the several advantages of the floatation device 10 is that, while providing positive buoyancy and an aerodynamic configuration, it reduces the potential for injuring the person in distress B since the leading edges of the device 10 are not constructed of a hard material. In this regard, it should be noted that the foam core construction of the subassembly 14 extends beyond the hard plastic strengthening member 37, thereby acting as a cushion to prevent injury.

Figure 6:
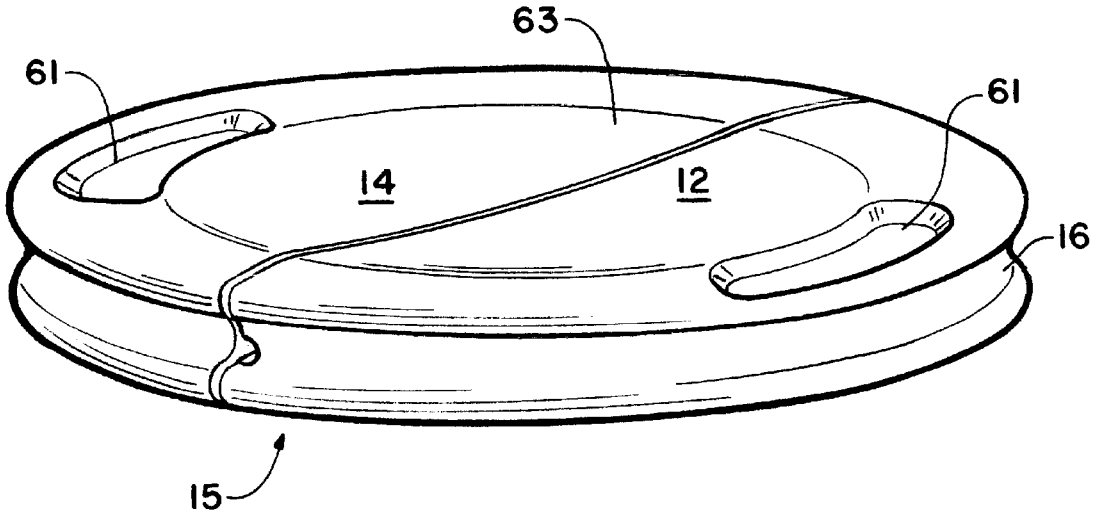
FIG. 6 is a perspective view showing the bottom surface of the preferred embodiment.

As seen in FIG. 6, the flotation device 10 has a bottom surface 63 which is generally concave. This concavity, combined with the generally convex top surface 65 contribute to the aerodynamic configuration of the device. Each of the subassemblies 12 and 14 includes a finger engageable recess 61 on the bottom surface 63. The recess 61 enables the rescuer A to grasp the disk 15, even under wet and cold conditions, or while the rescuer A is wearing a glove since the finger engageable recess 61 affords purchase of the device so that it can be thrown more accurately in the direction of the person in distress B.

The present invention may be embodied in other specific forms without departing from its spirit or essential characteristics. Thus, the described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A throwable rescue device, for deployment in water for rescue of a person in distress, comprising:

a disk, said disk including means for defining an annular groove, said disk further including a pair of identical and separable subassemblies;

a harness fixed to each one of said subassemblies; and a line, releasably wound around said disk and disposed in said annular groove, said line being fixed at an end to said harness wherein, upon deployment of said rescue device, said subassemblies separate completely from one another so as to be connected to one another only by said harness.

2. The device according to claim 1 wherein said harness includes a plurality of straps.

3. The device according to claim 1 wherein said harness includes at least one graspable strap loop.

4. The device according to claim 1 wherein said harness includes a plurality of graspable strap loops.

5. The device according to claim 1 wherein at least one of said separable subassemblies includes a portion defining a recess for receiving said harness.

6. The device according to claim 5 wherein at least one of said separable subassemblies includes a line receiving groove, said groove extending radially from said recess.

7. The device according to claim 1 wherein each one of said pair of separable subassemblies includes a portion defining a recess for receiving a portion of said harness.

8. The device according to claim 1 wherein each one of said pair of separable subassemblies is composed of closed cell foam.

9. The device according to claim 1 including cushioning means disposed along the outside edge of said disk.

10. The device according to claim 9 wherein said cushioning means includes a pair of closed cell foam lips disposed one above said annular groove and another one disposed below said annular groove.

11. The device according to claim 1 wherein said disk includes a generally convex top surface.

12. The device according to claim 1 wherein said disk includes a generally concave bottom surface.

13. The device according to claim 1 wherein at least one of said separable subassemblies includes a portion defining a finger engageable recess.

14. The device according to claim 1 wherein said line has a length of between about 50 feet and about 100 feet.

15. The device according to claim 1 wherein said line has a length of between about 5 feet and about 50 feet.

16. The device according to claim 1 wherein said line is composed of material selected from the group consisting of polyethylene and polyester.

17. The device according to claim 1 including means for strengthening each one of said pair of separable subassemblies.

18. The device according to claim 17 wherein said strengthening means includes subassembly alignment means.

19. The device according to claim 18 wherein said alignment means includes peg means and peg receiving means.

20. The device according to claim 19 wherein said peg means is a truncated cone projecting radially from said strengthening means.

21. The device according to claim 17 wherein said strengthening means includes a curved member, said member being disposed adjacent the outside edge of at least one of said pair of separable subassemblies.

22. The device according to claim 17 wherein said strengthening means includes a portion defining a recess.

23. The device according to claim 22 wherein a portion of said harness is fixed to said portion defining a recess.

24. The device according to claim 17 wherein said strengthening means is attached to at least one of said pair of separable subassemblies.

25. The device according to claim 17 wherein a portion of said harness is fixed to said strengthening means.

* * * * *